US012409966B2

(12) United States Patent
Cartalemi et al.

(10) Patent No.: US 12,409,966 B2
(45) Date of Patent: Sep. 9, 2025

(54) WOOD BUNDLING AND BAGGING SYSTEM

(71) Applicant: Global Land Equipment, Inc., East Moriches, NY (US)

(72) Inventors: Kenneth J Cartalemi, East Moriches, NY (US); Matthew Cartalemi, Moriches, NY (US); Dean Battaglia, Shirley, NY (US)

(73) Assignee: Global Land Equipment, Inc., East Moriches, NY (US)

( * ) Notice: Subject to any disclaimer, the term of this patent is extended or adjusted under 35 U.S.C. 154(b) by 218 days.

(21) Appl. No.: 18/223,251

(22) Filed: Jul. 18, 2023

(65) Prior Publication Data

US 2024/0101293 A1 Mar. 28, 2024

Related U.S. Application Data

(60) Provisional application No. 63/410,911, filed on Sep. 28, 2022.

(51) Int. Cl.
*B65B 35/50* (2006.01)
*B65B 5/06* (2006.01)
*B65B 57/14* (2006.01)

(52) U.S. Cl.
CPC ..... *B65B 35/50* (2013.01); *B65B 5/067* (2013.01); *B65B 57/14* (2013.01)

(58) Field of Classification Search
CPC ..... B65B 5/067; B65B 35/50; B65B 57/14
See application file for complete search history.

(56) References Cited

U.S. PATENT DOCUMENTS 3,546,829 A * 12/1970 Lonergan ..... B65B 5/067 53/260
3,653,506 A * 4/1972 Turner ..... B07C 5/14 209/933
4,788,812 A * 12/1988 Morita ..... B65B 35/50 53/247
4,871,059 A * 10/1989 Rantanen ..... B65G 47/8861 198/359
4,939,891 A * 7/1990 Podini ..... B65B 35/50 53/247
6,629,592 B2 * 10/2003 Bernard ..... B65G 47/44 198/360

(Continued)

*Primary Examiner* — Thanh K Truong
*Assistant Examiner* — David G Shutty
(74) *Attorney, Agent, or Firm* — Betsy Kingsbury Dowd, Esq.; BKDowd Law, P.C.

(57) ABSTRACT

A system and method for bundling wood includes a bin portion collecting logs that drop off a conveyor platform in a transverse orientation relative to a direction of travel. A first sensor detects each log as it drops, forming a stack, and a control module maintains a running count of the logs in the stack. A hatch automatically opens and simultaneously drops a stack of logs therethrough based on the running count, e.g., based on the running count equaling a preselected number. A second sensor above the bin portion measures a distance from the second sensor to the stack. The hatch automatically opens to drop the stack therethrough to a lower bin in response to the running count reaching the preselected number of logs and/or the distance reaching a predetermined distance. A third sensor positioned adjacent a lower hatch in the lower bin automatically closes the hatch when blocked by the stack.

22 Claims, 11 Drawing Sheets

(56) References Cited

U.S. PATENT DOCUMENTS

| | | | | |
|---|---|---|---|---|
| 10,035,611 | B2 * | 7/2018 | Holtet | B65G 47/38 |
| 11,465,792 | B2 * | 10/2022 | Kapicki | B65B 5/067 |
| 2008/0008509 | A1 * | 1/2008 | Hamers | B65H 31/32<br>399/405 |
| 2008/0257686 | A1 * | 10/2008 | Freudelsperger | B65G 69/16<br>198/468.8 |
| 2014/0196408 | A1 * | 7/2014 | Murray | B65B 61/24<br>53/540 |
| 2018/0257800 | A1 * | 9/2018 | Hulleman | B65B 25/04 |
| 2024/0101293 | A1 * | 3/2024 | Cartalemi | B65B 57/14 |

* cited by examiner

WOOD BUNDLING AND BAGGING SYSTEM

CROSS-REFERENCE TO RELATED APPLICATIONS

This application claims the benefit of and priority to U.S. Provisional Application Ser. No. 63/410,911 entitled "WOOD BUNDLING SYSTEM," filed Sep. 28, 2022, the entirety of which is hereby incorporated herein by reference thereto.

FIELD OF DISCLOSURE

The present disclosure relates generally to a wood bundling system and, in particular, to an automated bundling system for wood, for example, firewood logs and to a bundling system including a bagging portion.

BACKGROUND

There are systems known for automated bundling of firewood logs, but they are complex systems which include complicated one-by-one capturing and aligning of each log on a hatch before adding it to a stack.

Accordingly, there is still a need for a more efficient system and method for automated bundling of wood in aligned stacks for bagging, as well as for bagging the stacks of wood in an efficient manner.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a system for bundling and bagging wood as shown and described herein. The present disclosure is also directed to a method of bundling wood as shown and described herein.

The present disclosure is directed to a system for bundling wood, for example, that includes a bin-adjacent conveyor platform configured to transport logs in a transverse orientation relative to a direction of travel of the bin-adjacent conveyor platform, such that a longitudinal axis of each of the logs on the bin-adjacent conveyor platform is in a transverse orientation relative to the direction of travel. The system also includes a bin portion, wherein an end of the bin-adjacent conveyor platform is positioned above the bin portion, such that each log sequentially drops off the end of the bin-adjacent conveyor platform in the transverse orientation into the bin portion.

The system may also include a first sensor positioned before the end of the bin-adjacent conveyor platform; a lower hatch formed in a bottom of the bin portion; and a control module, operatively connected to the first sensor. The first sensor is configured to detect each log as it passes the first sensor in the transverse orientation and before it sequentially drops off the end of the bin-adjacent conveyor platform. The control module, in embodiments, includes a processor, and is configured to maintain a running count of the logs detected by the first sensor, and wherein the lower hatch is configured to hingedly open and simultaneously drop a stack of logs therethrough based on the running count.

In embodiments, the bin portion includes an upper bin including an upper hatch formed in a bottom of the upper bin and an upper actuator operatively connected to the control module and to the upper hatch. The bin portion may further include a lower bin positioned below the upper bin, and includes the lower hatch. The upper bin is configured to receive each log detected by the first sensor and sequentially dropped off the end of the bin-adjacent conveyor platform to form the stack of logs, and wherein the control module is operatively connected to the upper actuator and is configured, via the upper actuator, to automatically open the upper hatch to drop the stack of logs into the lower bin based on the running count of logs.

In embodiments, the control module is configured, via the upper actuator, to automatically open the upper hatch to drop the stack of logs into the lower bin in response to the running count of logs equaling a preselected number of logs.

In additional embodiments, the system further includes a second sensor positioned above the bin portion and past an end of the bin-adjacent conveyor platform, wherein the second sensor is operatively connected to and in communication with the control module and is configured to measure a distance from the second sensor to an uppermost log of the stack of logs in the upper bin, or to the upper hatch in an absence of logs in the upper bin. In embodiments, the distance is communicated to the control module, and the control module is configured, via the upper actuator, to automatically open the upper hatch to drop the stack of logs into the lower bin in response to one of the running count of logs reaching the preselected number of logs and the distance from the second sensor and the uppermost log reaching a predetermined distance.

Embodiments of the system may further include a third sensor positioned and configured to detect a presence of logs on the lower hatch in the lower bin. The third sensor is operatively connected to and in communication with the control module. The control module may be configured, via the upper actuator, in embodiments, to automatically close the upper hatch in response to the third sensor detecting the logs in the lower bin corresponding to the stack of logs dropped into the lower bin from the upper bin.

The control module may be further configured to reset the running count to zero in response to the automatic closing of the upper hatch.

In further embodiments, the control module may be further configured to stop the bin-adjacent conveyor platform and then automatically open the upper hatch to drop the stack of logs in response to one of the running count of logs reaching the preselected number of logs and the distance from the second sensor and the uppermost log reaching a predetermined distance.

The control module may also be configured, in embodiments, to restart the bin-adjacent conveyor platform in response to the automatic closing of the upper hatch.

Embodiments of the system may further include a user control panel operatively connected to the control module and a display screen operatively connected to and associated therewith. The display screen may include at least one of a graphical indicator of the status of the upper bin and a display counter that continuously displays the number of logs in the upper bin based on the running count of logs, wherein the control module is configured to continuously update the at least one of the graphical indicator and the display counter to display the number of logs collected in the upper bin and to indicate, in response to the automatic closing of the upper hatch, an empty status of the upper bin.

The system may further include, in embodiments, a user control panel operatively connected to the control module and a display screen operatively connected to and associated therewith, the display screen including a lower bin status indicator configured to display a status of the lower bin as empty or full based on the third sensor, wherein the status switches to full in response to the third sensor detecting the logs in the lower bin corresponding to the stack of logs dropped into the lower bin from the upper bin.

In embodiments, the system includes a user control panel operatively connected to the control module, and a bagging portion adjacently below the lower bin. The user control panel may also include a user operable switch operatively connected to the lower actuator and configured to allow a user to open and close the lower hatch in use, via the user operable switch, to drop the stack of logs therethrough and into the bagging portion.

The system, in embodiments, may further include a lower actuator operatively connected to the control module and to the lower hatch, and a bagging portion positioned adjacently below the lower bin. The control module, in embodiments, may be configured to automatically open the lower hatch, via the lower actuator, and release the stack of logs into the bagging portion in response to the third sensor detecting the presence of logs in the lower bin corresponding to the stack of logs dropped from the upper bin.

In further embodiments, the system may further include a main conveyor device onto which the logs are fed in a random orientation from a log hopper; a slotted conveyor platform positioned to transport the logs that exit from the main conveyor device; and a transitional conveyor belt positioned to move and transfer the logs that exit the slotted conveyor platform to the bin-adjacent conveyor platform in the longitudinal orientation. The slotted conveyor platform, in embodiments, includes a plurality of flat plates spaced apart on each of a plurality of rotatable axles, the plurality of rotatable axles being parallel to each other and spaced apart along the direction of travel of the slotted conveyor platform, wherein the plurality of rotatable axes and the plurality of flat plates are positioned and configured to urge each of the logs in a longitudinal orientation with the longitudinal axis aligned with the direction of travel of the slotted conveyor platform.

The bin-adjacent conveyor platform may intersect the transitional conveyor belt perpendicular to the direction of travel of the transitional conveyor belt, such that the logs exiting the transitional conveyor belt are oriented in the transverse orientation relative to the direction of travel of the bin-adjacent conveyor platform.

The slotted conveyor platform, in embodiments, is positioned at a height above an input end of the transitional conveyor belt.

The system may further include a slide operatively connected between an exit end of the slotted conveyor platform and the input end of the transitional conveyor belt, wherein the slide is concave in cross-section transverse to the direction of travel, and wherein the direction of travel of the slide is curved and oriented to direct the logs in a downward and curved path and onto the input end of the transitional conveyor belt.

In additional embodiments, the main conveyor device is positioned parallel to the transitional conveyor belt, with the direction of travel of the transitional conveyor belt being parallel to but opposite that of the main conveyor device.

The system may further include a rotating arm connected to an outward extension of one axle of the plurality of rotatable axles proximate the slide and configured to operatively strike a portion of the slide as it rotates with the one axle, such that the rotating arm shakes the slide to urge the logs downward along the slide and to agitate the logs to loosen debris therefrom. The plurality of blades is also preferably configured to agitate the logs as they are urged along the direction of travel.

The present disclosure is also directed to a method of bundling wood for bagging, the method including: receiving into an upper bin, logs dropped sequentially off an end of a bin-adjacent conveyor platform to form a stack of logs in the upper bin, the upper bin including an upper hatch formed in its bottom floor; providing a first sensor positioned before the end of the bin-adjacent conveyor platform, a second sensor positioned above the upper bin, an upper actuator configured to open and close the upper hatch, and a control module operatively connected to, and in communication with, the first sensor, the second sensor, the upper actuator, and the bin-adjacent conveyor platform; detecting each log, via the first sensor, as it passes the first sensor and before it sequentially drops off the end of the bin-adjacent conveyor platform; maintaining, via the control module, a running count of the logs detected, via the first sensor, and dropped into the upper bin; measuring a distance, via the second sensor, from the second sensor to an uppermost log of the stack of logs in the upper bin, or to the upper hatch in an absence of logs in the upper bin; communicating the distance, via the second sensor, to the control module; and automatically opening the upper hatch, via the upper actuator in communication with the control module, in response to one of the running count of logs reaching a preselected number of logs, and the distance from the second sensor and the uppermost log reaching a predetermined distance, thereby dropping the stack of logs into a lower bin.

In embodiments, the method may further include stopping, via the control module, the bin-adjacent conveyor platform, in response to the one of the running count of logs reaching a preselected number of logs, and the distance from the second sensor and the uppermost log reaching a predetermined distance, and prior to the automatically opening the upper hatch.

The method may further include providing a third sensor positioned and configured to detect a presence of logs in the lower bin; detecting the stack of logs, via the third sensor, in the lower bin; automatically closing, via the upper actuator, the upper hatch in response to the detecting the stack of logs; and restarting the bin-adjacent conveyor platform, via the control module, and resetting the running count to zero, via the control module, in response to the automatically closing the upper hatch.

A lower hatch is preferably formed in a bottom of the lower bin, and a lower actuator is provided, which is configured to open and close the lower hatch. The method may further include opening and closing the lower hatch, via the lower actuator, to empty the lower bin, after the restarting the bin-adjacent conveyor platform step.

The receiving into the upper bin step may further include, in embodiments, receiving each log dropped sequentially off the end of the bin-adjacent conveyor platform in a transverse orientation, a longitudinal axis of each log being transverse to a direction of travel of the bin-adjacent conveyor platform.

The present disclosure is also directed to a vertical unit for bundling a stack of wood received from a conveyor platform. The vertical unit includes an upper bin, and a lower bin positioned below the upper bin. The upper bin is positionable to receive logs dropped from the conveyor platform, and includes an upper hatch formed in its bottom floor. The lower bin includes a lower hatch formed in a bottom floor of the lower bin.

The vertical unit may also include a first sensor configured to be positioned above an end of the conveyor platform, and further configured to detect each log as it passes the first sensor; and a control module operatively connected to the first sensor, the control module including a processor, and configured to maintain a running count of the logs detected by the first sensor. The vertical unit also includes an upper actuator operatively connected to the control module and to the upper hatch; and a second sensor positioned above the bin portion, wherein the second sensor is operatively connected to and in communication with the control module and is configured to measure a distance from the second sensor to an uppermost log of the stack of logs in the upper bin, or to the upper hatch in an absence of logs in the upper bin, and to communicate the distance to the control module. The control module is configured, via the control module, to automatically open the upper hatch, via the upper actuator, to drop the stack of logs into the lower bin in response to one of the running count of logs reaching a preselected number of logs and the distance from the second sensor and the uppermost log reaching a predetermined distance.

The vertical unit, in embodiments, further includes a third sensor positioned and configured to detect a presence of logs on the lower hatch in the lower bin, the third sensor being operatively connected to and in communication with the control module. The control module is configured, via the upper actuator, in embodiments, to automatically close the upper hatch in response to the third sensor detecting the stack of logs dropped into the lower bin from the upper bin, and, in embodiments, to reset the running count to zero in response to the automatic closing of the upper hatch.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

Figure 1:
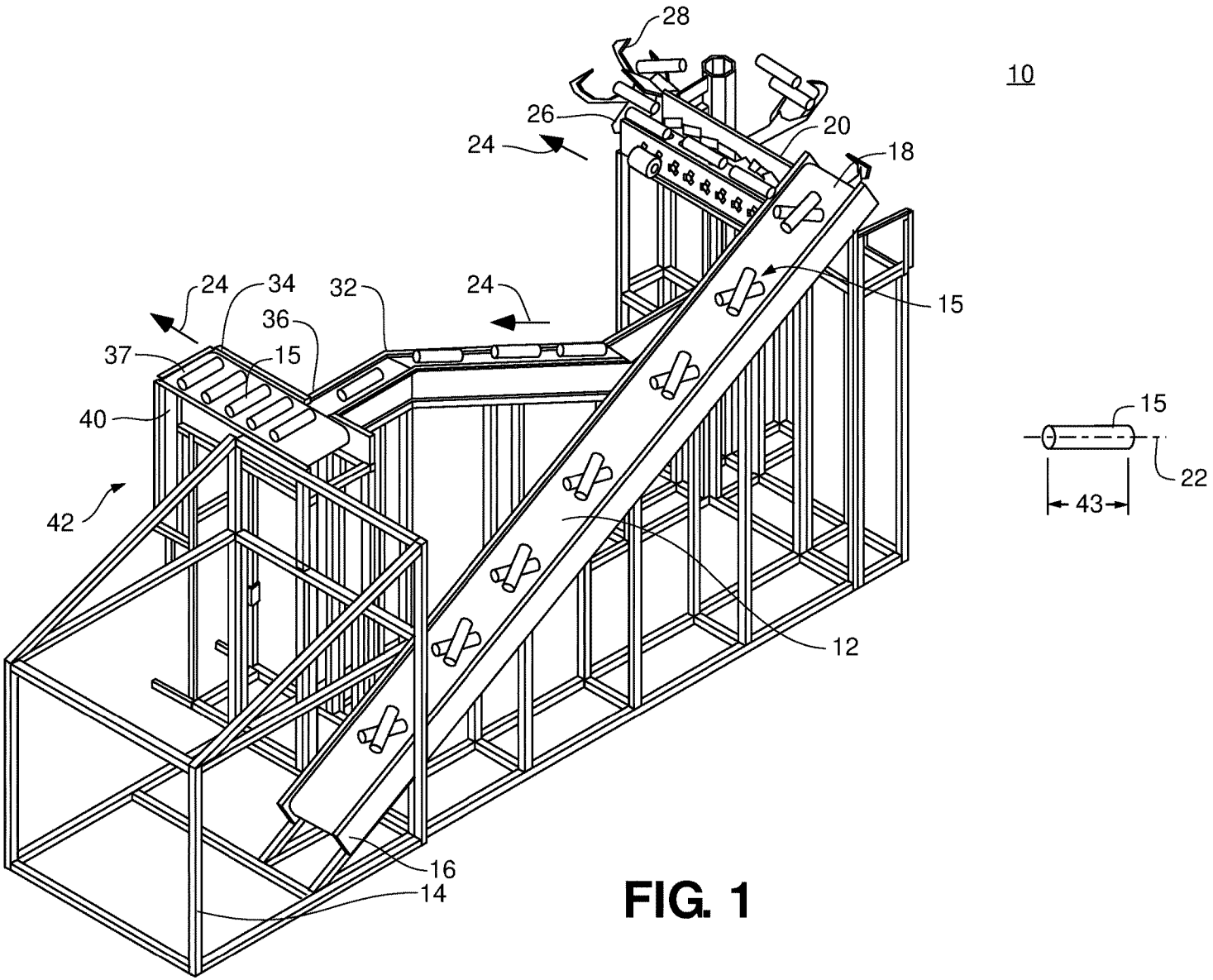
FIG. 1 is a pictorial, perspective, representation of an embodiment of a system of the present disclosure.

The various aspects of the present disclosure mentioned above are described in further detail with reference to the aforementioned figures and the following detailed description of exemplary embodiments.

DETAILED DESCRIPTION

The following sections describe exemplary embodiments of the system and components of the system of the present disclosure and methods associated therewith. It should be apparent to those skilled in the art that the described embodiments of the present disclosure provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure and of the system, its components, and methods associated therewith as defined herein and equivalents thereto.

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure of a wood bundling and bagging system and components and methods associated therewith as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, or where methods are described as having, including, or comprising one or more specific steps, it is contemplated that, additionally, there are items of the present disclosure that consist essentially of, or consist of, the one or more recited components or features, and that there are methods according to the present disclosure that consist essentially of, or consist of, the one or more recited processing steps.

The present disclosure is directed to an automated wood bundling system, for bundling firewood logs, for example. The present disclosure is also directed to vertical unit configured to perform the automatic bundling and bagging of stacks of logs received from the conveyor system, which may be incorporated as a unit into any conveyor system for bundling and bagging wood.

The term "conveyor platform" as used in the present disclosure refers to the moving platform of a mechanical transport apparatus for conveying articles positioned on the conveyor platform from one location to the other via the mechanical transport apparatus. A mechanical transport apparatus is also referred to herein as a "conveyor" and the system of multiple conveyors of the present disclosure is referred to herein as a conveyor system, or conveyor portion of the wood bundling system. The conveyor platform may be, for example, but is not limited to, the moving platform of a conventional conveyor belt system, or any other suitable mechanical transport apparatus, or conveyor apparatus.

Referring to FIG. 1, an embodiment of a system 10 of the present disclosure includes a main conveyor platform 12, onto which logs 15 are fed from a log hopper 14, in a randomly oriented and unaligned manner, onto a first, or loading, end 16 of the main conveyor platform 12. In embodiments, referring also to FIG. 2B, the system may further include a slotted conveyor platform 20, which is formed from a plurality of rotating axles 21 spaced apart along the direction of travel 24 and aligned parallel to each other, the open spacing between the rotating axles 21 forming slots 19 therebetween. Each one of the rotating axles 21 includes a plurality of flat plates 23, also referred to herein as blades 23, each of which is fixed and centered on, and rotate with, the rotating axles, and which may be of rectangular, or square shape, positioned equidistant from each other along each one of the rotating axles 21. As shown in FIG. 2B, in embodiments, the transverse position of each of the blades 23 along one of the rotating axles is staggered relative to the blades 23 on an adjacent rotating axle 21'. The rotation of the rotating axles 21 and of the blades 23 therewith, moves the logs 15 along the slotted conveyor platform 20, while the shape and positioning of the blades 23 both aligns the longitudinal axis 22 of the logs 15 in the direction of travel 24, and agitates the logs 15 so that dirt and debris is shaken off of the logs 15, and falls through the slots 19.

Figure 2A:
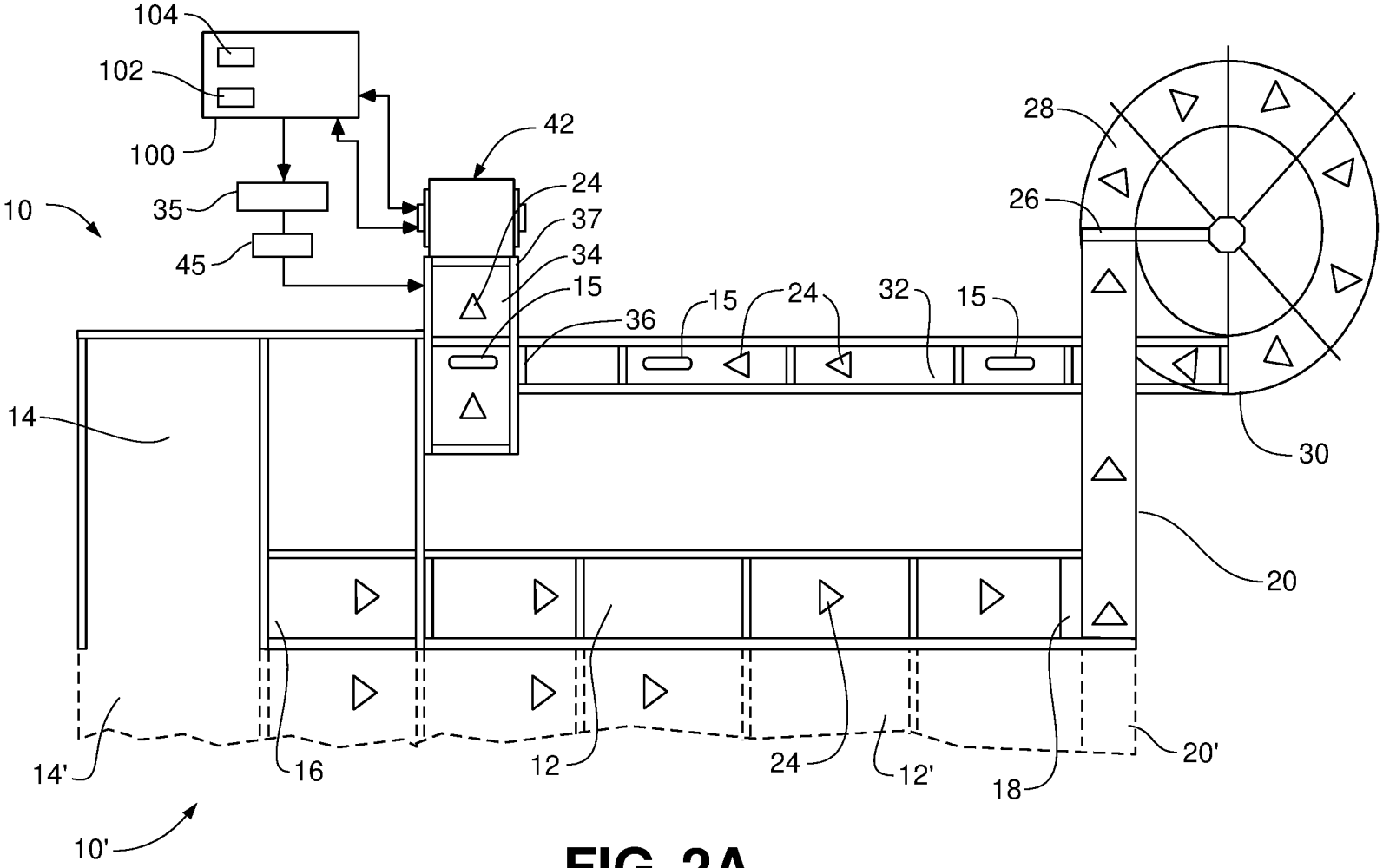
FIG. 2A is a top view of an embodiment of FIG. 1.
Figure 2B:
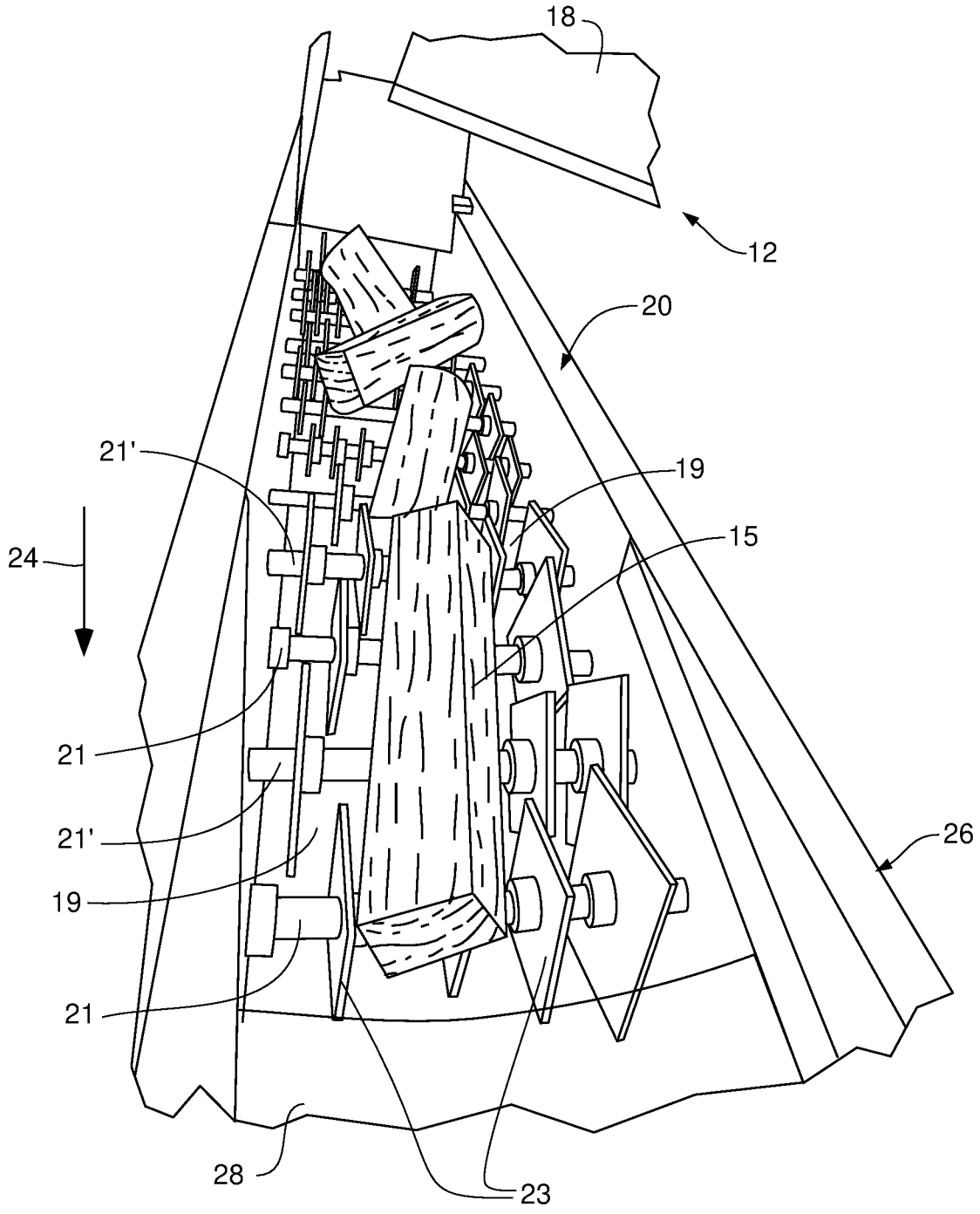
FIG. 2B is a perspective top view of a portion of an embodiment of the system, with a magnified view of a slotted conveyor platform configured.

Referring also to FIGS. 2A and 2B, the logs 15 are translated along the main conveyor platform 12, which is, in embodiments, inclined upward from the first end 16 to a second end 18, from which the logs 15 are dropped onto the slotted conveyor platform 20, which orients the logs 15 in the direction of travel 24 on the slotted conveyor platform 20. In embodiments, the slotted conveyor platform 20 is substantially horizontal.

Figure 2C:
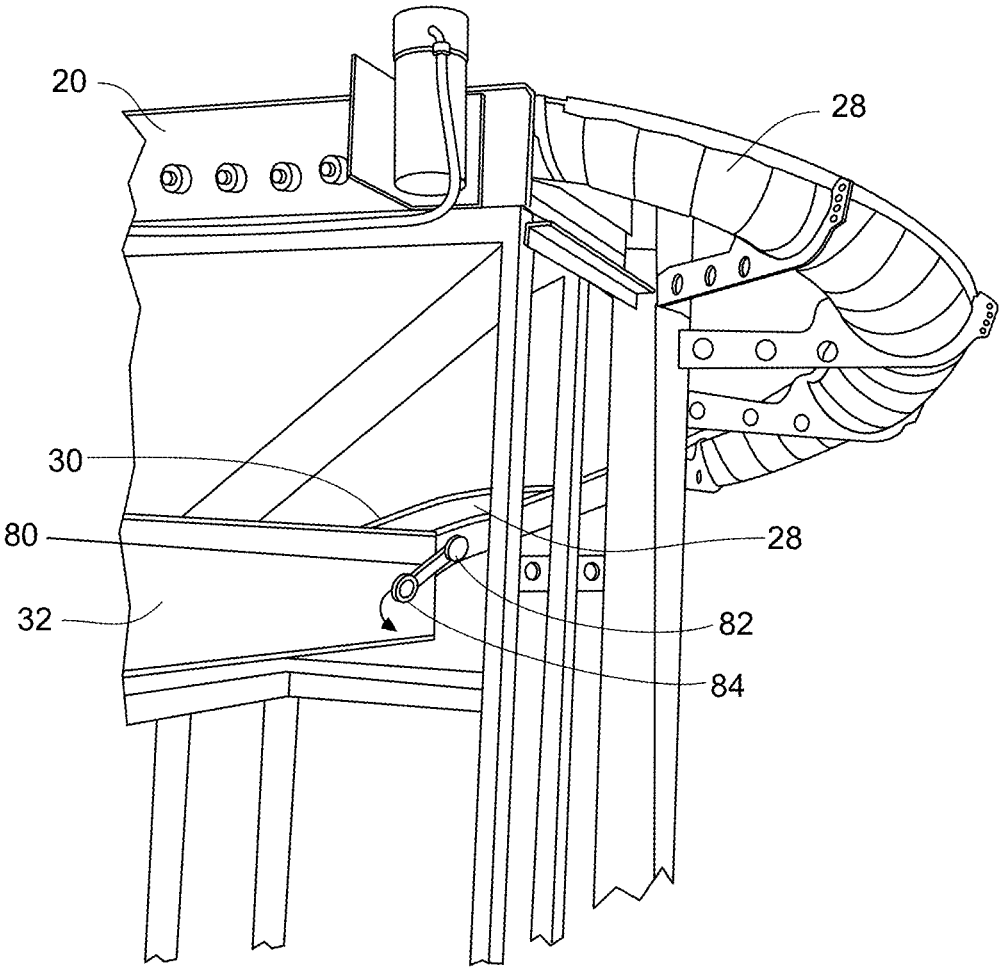
FIG. 2C is a perspective bottom, side view of a portion of the embodiment of FIG. 2B, showing the slide.

Referring to FIGS. 1, 2A and 2B, in embodiments, the system may also include a slide 28 positioned at an exit end 26 of the slotted conveyor platform 20, which may have a concave shape in cross-section transverse to the direction of travel 24. In FIG. 1, only the ribs of the slide 28, the structure of which is best represented in FIG. 2C, are shown so that the logs 15 and their direction of travel within the slide 28 are visible in FIG. 1. The logs 15 exit the slotted conveyor platform onto the slide 28, which is, in embodiments, curved and oriented to redirect the logs 15 in a circular path downward and underneath the slotted conveyor platform 20 (see also FIG. 2C). From a lower end 30 (see FIGS. 2A and 2C) of the slide 28, referring also to FIG. 1, the logs 15, in embodiments, are loaded onto another conveyor platform 32, referred to as a transitional conveyor platform 32, which is substantially parallel to, and preferably less than a horizontal length of, the main conveyor platform 12. The logs 15 are still aligned along the direction of travel 24 with the direction of travel 24 being parallel to, and, in embodiments, in the opposite direction to, that of the main conveyor platform 12. It should be noted that each of the logs 15 is not necessarily traveling one after another, or in "single file," but may be partially or fully adjacent to another log 15 on the transitional conveyor platform 32.

Referring to FIG. 2C, to help urge the logs 15 down the slide 28, in embodiments, the system may also include a rotating arm 80 having a free, first end 82, which is round in embodiments, configured to operatively contact the slide 28 (i.e., from direct, or indirect contact, e.g., via a bracket that contacts and supports the slide 28) on every rotation, thereby shaking or vibrating the slide 28. In embodiments, as shown in FIG. 2C, a second end 84 of the rotating arm 80 is connected to a rotating axle 86 that also moves the transitional conveyor platform 32 in the direction of travel 24.

It should be noted that while FIG. 2A shows one complete system 10, it is contemplated that a second system 10' may be added adjacent to the system 10 as indicated, that is a mirror image of system 10, so that a log hopper 14' of the second system 10' is side by side with the log hopper 14 of system 10, the main conveyor platforms 12, 12' of each of the first 10 and second system 10' run parallel to each other, the slotted conveyor platforms 20, 20' extend adjacently in opposite directions in mirror image, and so on, as represented in FIG. 2A. This configuration allows a single truckload of logs to be emptied into both log hoppers 14, 14' simultaneously, and also provides double the number of bags of wood to be acquired in the same time it would take the one system 10.

Figure 3:
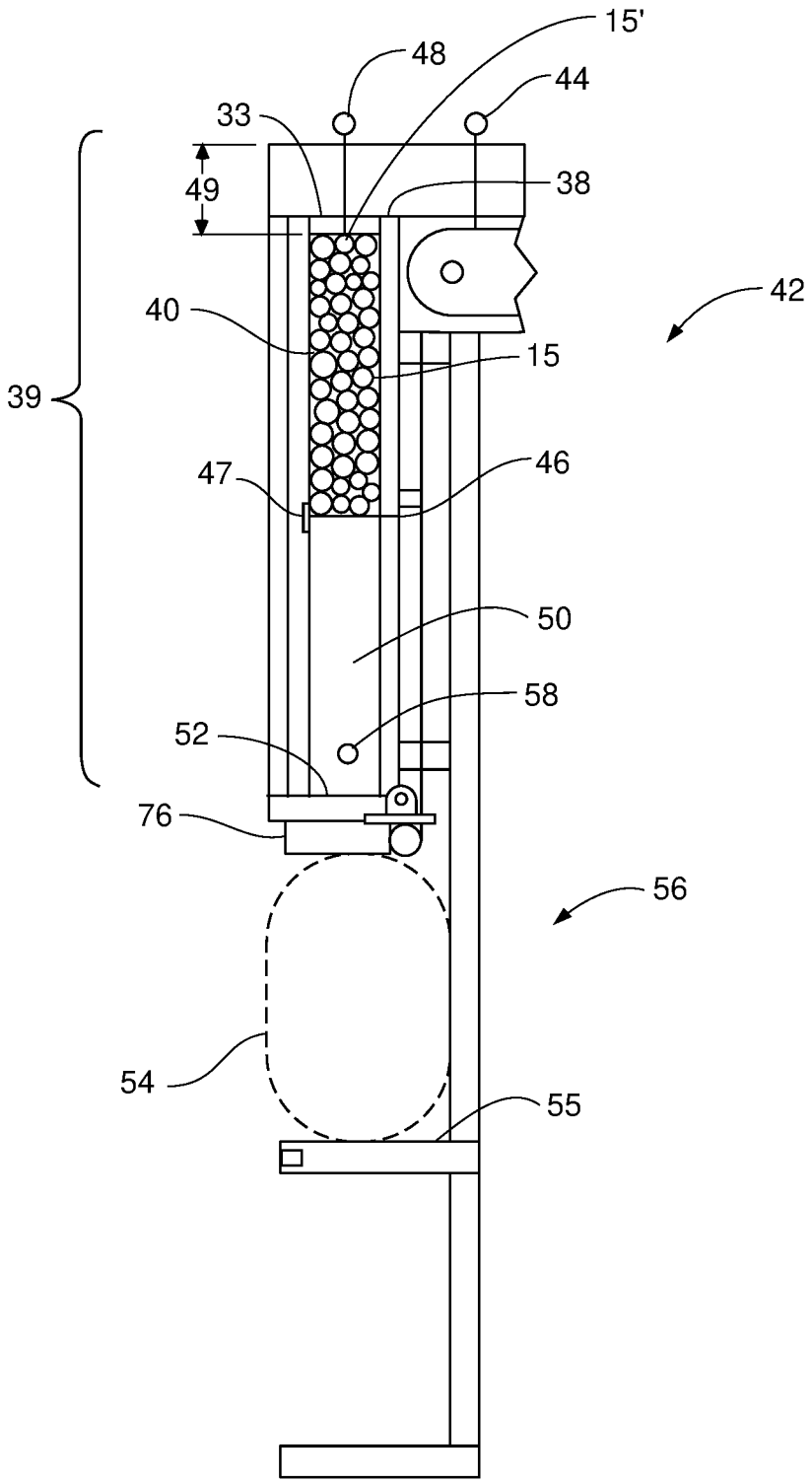
FIG. 3 is a side view of an embodiment of a vertical unit of the system of the present disclosure, which includes a bin portion for receiving stacks of logs and a lower open portion configured for bagging the stacks.

Referring, for example, to FIGS. 1 and 2A, in embodiments, the system 10 also includes another conveyor platform 34, which is positioned above and adjacent to a bin portion 39 of the system and is configured to drop the logs 15 into the bin portion 39. Conveyor platform 34, which is referred to herein as bin-adjacent platform 34, intersects the transitional conveyor platform 32, at its exit end 36, at a right angle to the direction of travel 24, so that the longitudinal axis 22 of each of the logs 15 conveyed from the transitional conveyor platform 32 onto the bin-adjacent conveyor platform 34 is now transverse to the direction of travel 24. Accordingly, once the logs 15 are loaded (could be one at a time or multiple logs 15 at a time) in this transverse orientation onto the bin-adjacent conveyor platform 34, they are conveyed one after another along the bin-adjacent conveyor platform 34, with their longitudinal axes 22 oriented parallel to each other. Referring also to FIG. 3, this ensures that the logs 15 will drop one by one, oriented transverse to the direction of travel 24, off an end 37 of the bin-adjacent conveyor platform 34 and into the bin portion 39. The bin portion 39 is configured to receive the logs 15 through an opening 33 in its ceiling 38, and collect the logs 15 in a stack 17. The longitudinal axis 22 of each of the logs 15 dropped into the bin portion 39 aligns parallel with an inner width 41 of the upper bin portion 39 to maintain a neat stack.

In embodiments, the bin portion 39 includes an upper bin 40 and a lower bin 50, such that the logs 15 drop off the end 37 of the bin-adjacent conveyor platform 34 and into the upper bin 40. Advantageously, the transverse direction of travel 24 of the logs 15 on the bin-adjacent conveyor platform 34 ensures that the longitudinal axis 22 of the logs 15 is transverse to the direction of travel 24 as they fall off the end 37 of the bin-adjacent conveyor platform 34 and into the upper bin 40. This negates the need for any other means of "catching" and aligning each singular log 15 to form the stack 17 of logs 15. The logs 15 are already oriented in the same direction, with their longitudinal axes 22 parallel to each other, to neatly stack up in the upper bin 40 as they fall off the bin-adjacent conveyor platform 34.

In embodiments, the system 10 includes a vertical unit 42, which includes the bin portion 39, and is, in embodiments, configured to automate the stacking and bagging of logs. Referring to FIG. 3, the vertical unit 42 also preferably includes a first sensor 44, also referred to herein as a counting sensor 44, configured to provide a count of the number of logs 15 that pass under it before dropping into the upper bin 40. The first sensor 44 may be, in embodiments, a photoelectric sensor, for example, a diffuse proximity sensor with the source and detector in a single package, or any other suitable sensor that may be positioned and configured for counting logs 15 that drop into the bin portion 39. Referring to FIG. 1 as well as FIG. 3, each log is counted as it passes the first (counting) sensor 44, which, in embodiments, is located above the end 37 of the bin-adjacent conveyor platform 34, just before one of the logs 15 drops into the upper bin 40. A bottom floor of the upper bin 40 is formed as a hatch, referred to herein as upper hatch 46, which is flat in a closed position, and is preferably configured to be hingedly opened and closed around a hinged side 47. In embodiments, referring also to FIG. 5A, the vertical unit 42 further includes a first (or upper) actuator 60, which may be a pneumatic actuator, operably connected to the upper hatch 46 and configured to drive the upper hatch 46 open and closed.

Figure 6A:
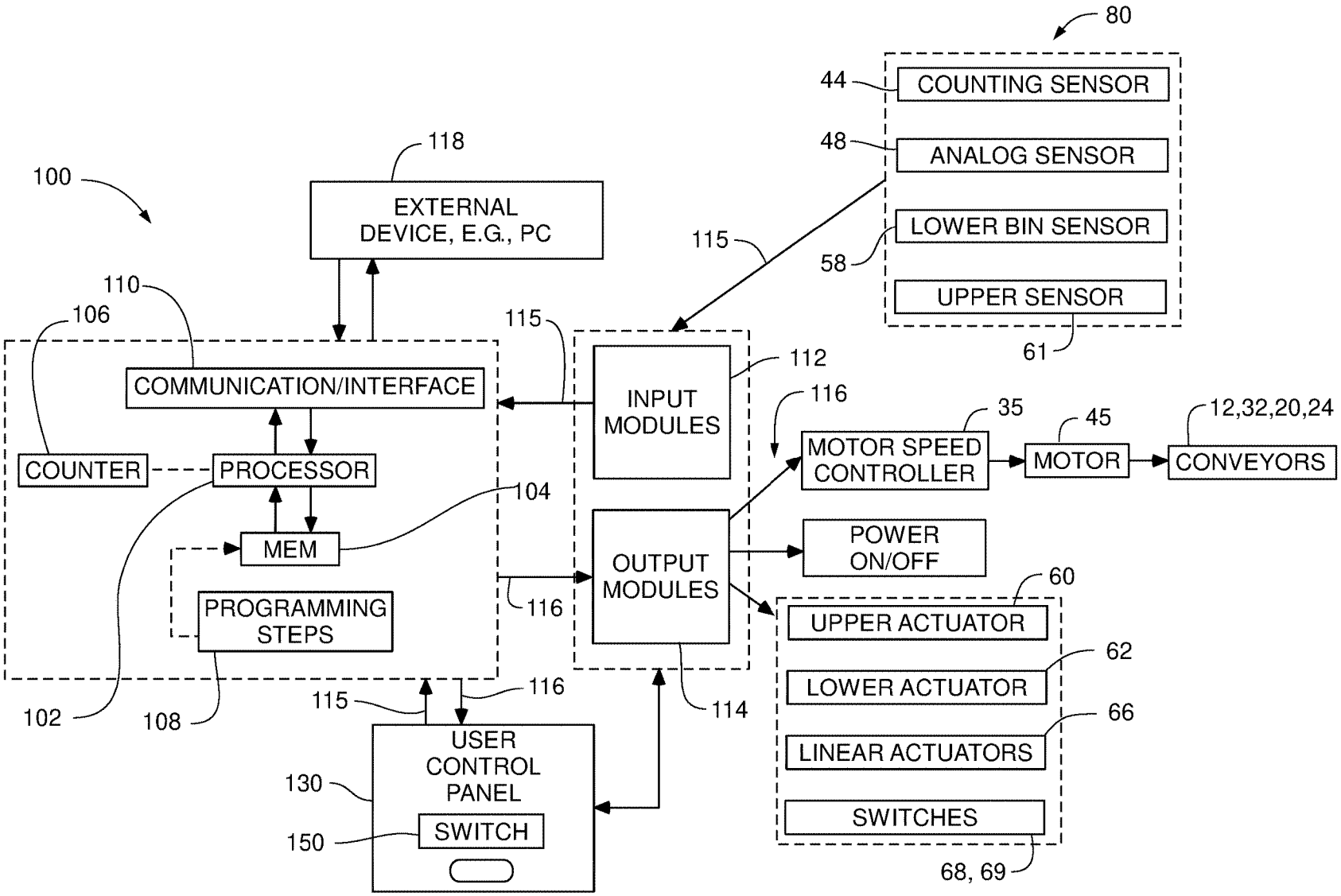
FIG. 6A is a schematic representation of an embodiment of a control module and its interaction with other portions of the system of the present disclosure.
Figure 6B:
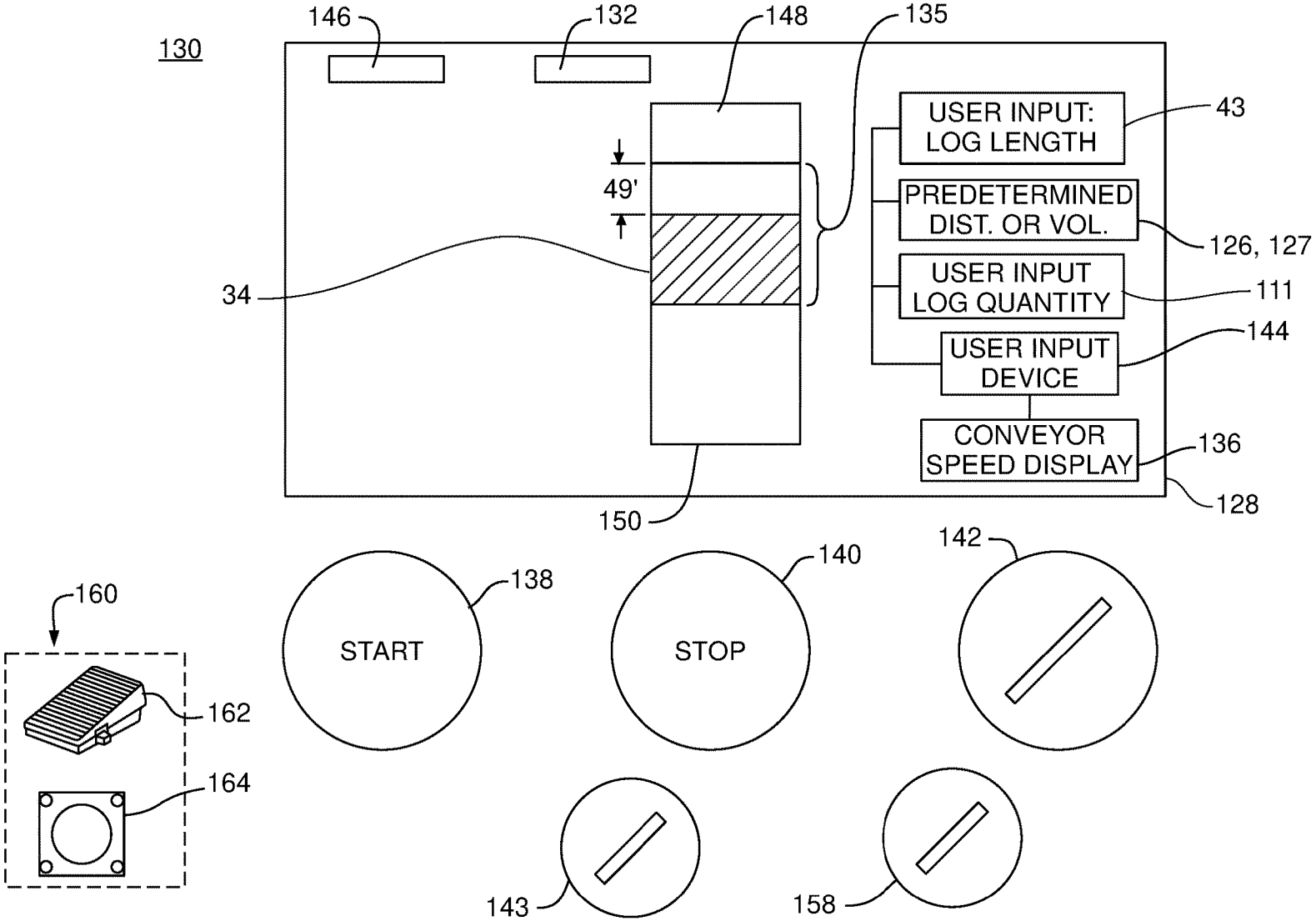
FIG. 6B is a schematic representation of an embodiment of a user control panel of the present disclosure.

Referring also to FIG. 2A, as well as to FIGS. 6A and 6B, in embodiments, a control module 100, which may be a programmable logic controller, is provided with the system 10. The system 10 also preferably includes a user control panel 130, which is in operable communication with the control module 100, and which allows, inter alia, user selection of control toggles and input of various parameters. The control module 100 includes a processor 102, which may be a central processing unit (CPU), a microprocessor, or a plurality of microprocessors, for example, and memory 104, configured to store parameters, including user-input data, and instructions, or programming steps 108, which when executed by the processor 102, performs the steps and processes described herein. The control module 100 is operatively connected to the first sensor 44 and to the upper hatch 46, and may include a counter 106, which may be part of the processor 102, which may be configured to receive a signal from the first (counting) sensor 44 each time a log 15 passes under the sensor 44, and maintain a running count of the logs 15 based on the number of signals received. In embodiments, a preselected number 111 of logs 15 for forming the stack 17 may be input to the control module 100 by a user via the display screen 128, such as a touch screen display. In embodiments, the preselected number may be selected via a drop down list of numbers. The preselected number 111 may be displayed on a display screen 128, which may be a touch screen, in embodiments, associated with the user control panel 130. The running count of the logs 15 dropped into the bin portion 39 may also be continuously updated and displayed on a counter display portion 132, also referred to herein as the display counter 132, of the display screen 128.

Figure 5A:
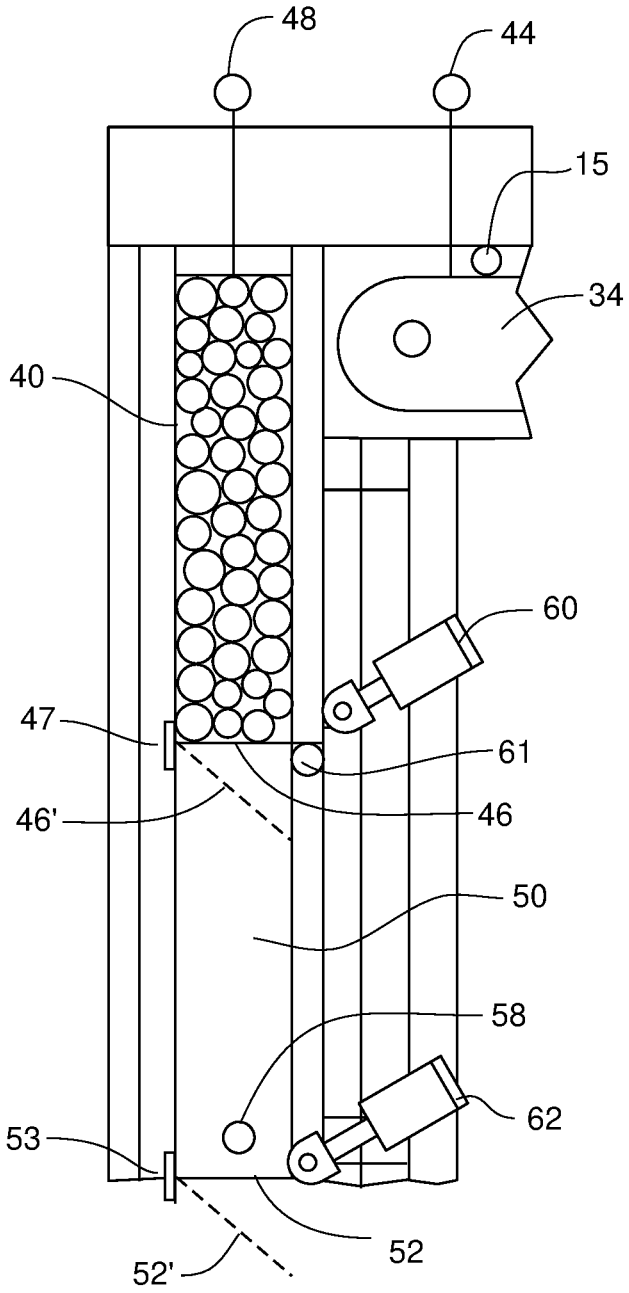
FIG. 5A represents a side view of a bin portion of the vertical unit.
Figure 5B:
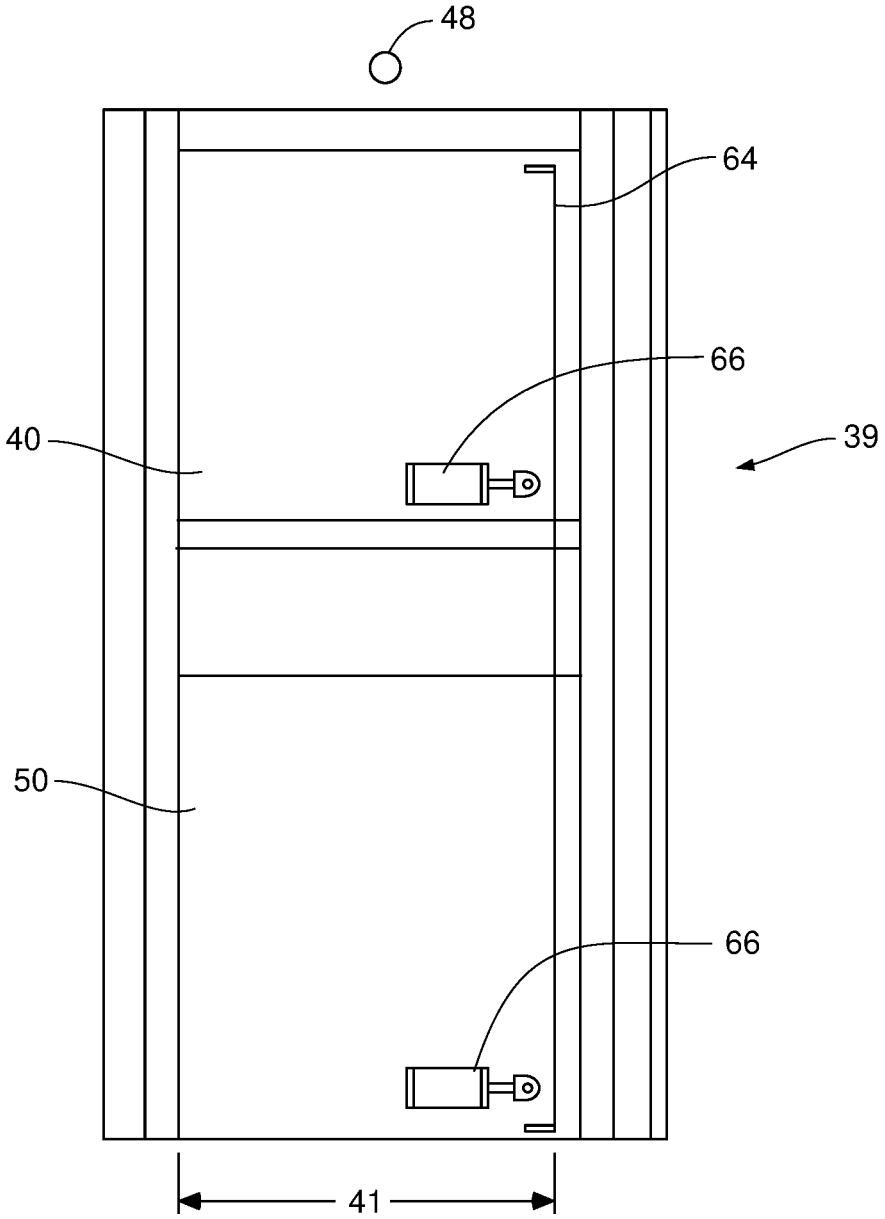
FIG. 5B represents a front view of a bin portion of the vertical unit.

Referring to FIG. 5B, in embodiments, the bin portion 39 also includes a movable wall 64 configured to be translated via linear actuators 66. Referring also to FIG. 6B, prior to initializing the process of bagging the logs 15, a user may also enter a length 43 of the logs 15 via the user control panel 130, which may be displayed on the user control panel 100. It should be noted that the length 43 of a log 15 is measured along its longitudinal axis 22, as noted in FIG. 1, and is greater than a diameter or width of the log 15. After the length 43 is entered, or, in embodiments, selected from a drop down list of lengths displayed on the display screen 128, the linear actuators 66 will adjust the movable wall 64 so that the inner width 41 of the bin portion 39 corresponds to a width that is based on the length 43 input by the user. For example, the length 43 input by the user may have been adjusted upward by the user to accommodate anomalies in the logs 15 when cut. Alternatively, the control module 100 is configured to set the inner width 41 of the bin portion 39 via the movable wall 64 to the length 43 input by a user plus an additional predetermined percent, so that the inner width 41 is set to accommodate anomalies in the nominal length of the logs 15.

After the preselected number 111 of logs 15 are counted via the first sensor 44 as having dropped into the upper hatch 46, the control module 100, in embodiments, may signal the first actuator 60 to open the upper hatch 46, dropping all of the logs 15 collected in the upper bin 40 in one stack.

As best seen in FIG. 5A, an additional sensor 61, referred to as an upper hatch sensor 61, and which may be, in embodiments, a proximity sensor, such as an inductive proximity sensor, is positioned below a nominal position of the upper hatch 46 when in the closed position and opposite the hinged side 47. The upper hatch sensor 61 is configured to detect when the upper hatch 46' is open, the upper hatch 46' swinging down in front of the upper hatch sensor 61 to trigger a signal to the control module 100. Likewise, the closing of the upper hatch 46 triggers the upper hatch sensor 61 to send another signal to the control module 100 indicating the upper hatch 46 is closed.

In embodiments, the system may further include a lower bin 50 adjacently below the upper bin 40, so that when the upper hatch 46 opens, the stack 17 of logs 15 drops into the lower bin 50. A bottom of the lower bin 50 is also formed as a hatch, referred to herein as a lower hatch 52, which is preferably configured to be hingedly opened and closed around a hinged side 53. In embodiments, the lower hatch 52 may be configured to be manually opened via a handle (not shown) attached to the lower hatch 52, and manually operable to hingedly swing the lower hatch 52 open around its hinged side 53. In other embodiments, referring to FIG. 5A, the lower hatch 52 may be operable via a second (or lower) actuator 62, which may be a pneumatic actuator, operably connected to the lower hatch 52 and configured to drive the lower hatch 52 from its closed position to an open position 52'.

In embodiments, the vertical unit 42 may also include an open portion 56, having a floor or platform 55, also referred to herein as a bagging portion 56, adjacently beneath the bin portion 39, e.g., in embodiments, below the lower bin 50. The open portion 56 is configured for bagging the stack 17 of logs 15 dropped through an opened, lower hatch 52'. In embodiments, referring also to FIG. 6A, the lower hatch 52 is configured to open and close via a user operable switch 160, which is operably connected to, and activates, the second actuator 62 via the user operable switch 160. Referring also to FIG. 6B, the user operable switch 160 may be toggled via a foot pedal 162 or a push-button 164, each of which, when depressed, will open the lower hatch 52 and drop the stack 17 into the bagging portion 56 of the system 10.

In further embodiments, the system 10 may also include a second (analog) sensor 48, which may, in embodiments, be an analog sensor, or analog output or displacement sensor. The second sensor 48 is preferably positioned above the bin portion 39, in embodiments, above the upper bin 40, and past the end of the bin-adjacent conveyor platform 34. The second sensor 48 is configured to generate an output signal proportional to a distance 49 (see FIG. 3, and graphical display of 49' in FIG. 6B) between the second sensor 48 and an object in its field of view, namely, an uppermost log 15' in the upper bin 40, or when the upper bin 40 is empty, the upper hatch 46. Accordingly, the output signal can be processed by the control module 100 to determine whether the upper bin 40 is empty, and also to keep updating the distance 49. Referring also to FIGS. 6A and 6B, in embodiments, each of the counter 106 in the control module 100 and the display counter 132 in the display screen 128, is reset to zero to begin the counting process via the first sensor 44 again in response to receiving a signal from the second sensor 48 that the upper bin 40 is empty.

In other embodiments, the display counter 132 and counter 106 are reset to zero in response to the control module 100 receiving a signal from either the first (upper) actuator 62, or, in embodiments, from the upper hatch sensor 61, that the upper hatch 46 has opened and closed. In embodiments, once some additional checks have been performed, such as rechecking via the second sensor 48 that the upper bin 40 is empty, the upper bin 40 may begin to be filled up again. While the upper bin 40 begins to fill again, the lower hatch 52 may be opened via the user operable switch 160, which activates the second actuator 62, to drop the stack 17 of logs 15 into a bag 54, for example, positioned in the bagging portion 56 of the vertical unit 42 located below the lower bin 50 of the bin portion 39 and lower hatch 52.

In further embodiments, referring also to FIG. 6B, to account for variations in the sizes of the logs 15, and to form stacks 17 of logs 15 of similar volume or height, the distance 49 of the uppermost log 15' from the sensor 48 is also monitored and compared to a predetermined distance 126, which may be stored in the memory 104 of the control module 100. The predetermined distance 126 may be input by a user, or optionally, a predetermined parameter 127, such as a height, volume, or weight of a stack 17 of logs 15 to be collected in the upper bin 40 before opening the upper hatch 46, may be input by a user via the user control panel 100 from which the predetermined distance 126 may be calculated via the processor 102, based on a height of the upper bin 40 and, in embodiments, on the length 43 of the logs 15 input by the user. In embodiments, while the counter 106 still monitors the number of logs 15 dropped into the upper bin 40, the control module 100 continues to allow logs 15 to drop into the upper bin 40 until the distance 49 of the uppermost log 15' in a stack 17 to the second sensor 48 reaches, i.e., equals or exceeds than (by one log) the predetermined distance 126 from the second sensor 48. In further embodiments, the control module 100 signals the first actuator 60 to open the upper hatch 46, dropping all of the logs 15 collected in the upper bin 40 in one stack, when this condition is achieved, i.e., in response to the control module 100 receiving a signal indicating that the distance 49 equals or exceeds the predetermined distance.

Referring to FIG. 6B, in embodiments, the user control panel 130 may include a graphical indicator 134, e.g., a data bar display, which is configured to graphically portray, in embodiments, as a colored bar 135, the rising height of the stack 17 in the upper bin 40, based on the distance 49.

Figure 4:
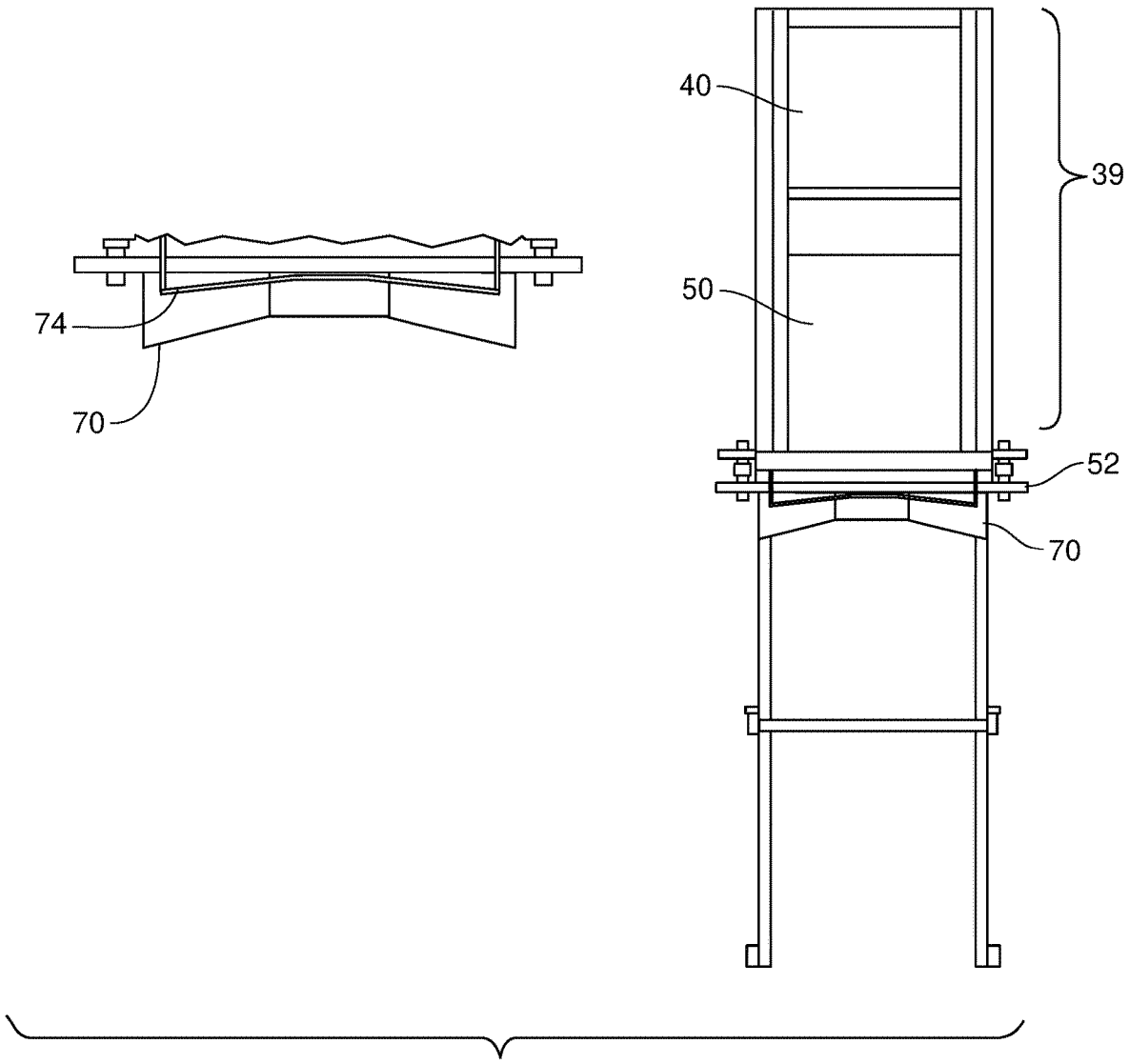
FIG. 4 is a front view of the vertical unit of FIG. 3.

Referring to FIGS. 3 and 4, the vertical unit 42, in embodiments, may include the bagging portion 56, which preferably includes the platform 55 on which a bag 54 filled with the stack 17 of logs 15 may rest, and may be configured to accommodate any type of bags, including, but not limited to, mesh, and plastic. In embodiments, a bag support flap 70 may be positioned below the lower hatch 52 with a front support bar 74 positioned in front of it, which hingedly rests against a back of a bag, and preferably, which holds a number of bags. A front of a single bag 54 may be pulled around a frame 76 positioned below the lower hatch 52 for bagging, wherein the single bag 54 may be removed after filling the bag 54 with logs 15 dropped through the lower hatch 52.

In additional embodiments, as shown in FIG. 3, for example, the system 10 may also include a third sensor 58, which may be a photoelectric sensor, for example, a diffuse proximity sensor, which is positioned and configured to determine whether the lower bin 50 is full or empty. In embodiments, the third sensor 58 may be located adjacent and just above the lower hatch 52 of the lower bin 50. As one of skill in the art will appreciate, the third (proximity) sensor 58 may be configured to switch between an on and off state in the presence and absence, respectively, or vice versa, of light reflected off a log 15 and back into the third sensor 58. Accordingly, the control module 100 may be configured, in embodiments, to activate the lower actuator 62 to automatically open the lower hatch 52 and release the stack 17 from the lower bin 50, in response to a signal from the third sensor 58 indicating the presence of logs 15 in the lower bin 50, while the upper loading bin 40 is being refilled. This can significantly increase the bagging process compared to prior art systems.

Referring to FIG. 6B, a switch 158 may be provided on the user control panel 130 that allows the operation of the lower hatch 52 to be set to manual operation, so that it is opened and closed via the manually operable switch 160, or to automated operation, so that it is automatically opened and closed via the control module 100.

The control module 100 may also be configured to identify, via the third sensor 58, if there are any logs 15 remaining after the lower actuator 62 has opened and closed, indicating that the lower bin 50 needs to be cleared before refilling the lower bin 50 with another dump of the stack of logs 15 from the upper bin 40. The display screen 128 associated with the control module 100 includes, in embodiments, a momentary switch 142 operable by a user, in both the manual operation and automated operation setting of the switch 158, which is operatively connected to the lower actuator 62, and is configured to open the lower hatch 52 via lower actuator 62 for as long as the momentary switch 142 is engaged by the user, to clear the lower bin 50. In embodiments, the processor 102 is configured to stop the conveyor system, via the motor controller 35, as well as to move the linear actuators 66 to increase the inner width 41 to its maximum width, and open the lower hatch 52 in response to the momentary switch 142 being activated by the user. In embodiments, the processor 102 is configured to also open the upper hatch 46, via upper actuator 60, when the momentary switch 142 is activated by the user to dislodge any stuck logs in the bin portion 39 and clear both the upper 40 and lower bin portion 50 from all logs before beginning to fill the upper bin 40 again.

Referring to FIG. 6A, the control module 100 includes memory 104, which stores a program 108, i.e., a set of instructions or programming steps 108, that when executed by the processor 102, performs the steps of the various methods and processes described herein. Data needed in the control of the system may also be stored in the memory 104, which may include non-volatile, e.g., flash memory, and/or volatile memory, e.g., random access memory (RAM).

Still referring to FIG. 6A, for communicating with the various sensors, actuators, drivers, motors and motor speed controllers, for example, of the system 10, and, in embodiments, with an external device 118, which may be any type of computer, e.g., the control module 100 also preferably includes a communication interface 110. The external device 118, in embodiments, may be used to upload updates to the program 108 and system parameters, and to log data generated by the bagging system 10 related to operation and efficiency in the bundling and bagging process.

The control module 100 may also include, or be in operative communication with, an input module 112 and an output module 114 configured to receive and send data and/or signals from input devices and to output devices, respectively. For example, the processor 102, in embodiments, receives input signals 115 from the sensors via the input module 112, including counting sensor 44, analog sensor 48, lower bin sensor 58, and upper hatch sensor 61, and executes the program instructions 108 that are stored in memory 104 based on the input signals 115 and/or data from the sensors. The processor 102 then sends output signals 116 and/or data based on the program instructions 108 and input signals 115 to the output devices, in accordance with the methods of the present disclosure, e.g., to actuators, such as upper actuator 60, lower actuator 62, and wall actuators 66, and to the user control panel 130.

The processor 102 is also configured to receive input signals 115 and data from the user control panel 130, in embodiments, via the input module 112, based on user input to the control panel 130, via the display screen 128 operatively connected to the user control panel 130, and on input signals 115 and data from the sensors. The display screen 128, which may be a touch screen display, is configured for both user input and display of data. The user control panel 130 may also be configured to send output signals or data 116 to the user control panel 130 for display on the user control panel 130, based on user input and/or on input signals 115, as further described herein. The processor 102 is further configured to execute instructions 108 via the output module 114 to certain output devices, as further described herein, based on user input to the user control panel 130.

Referring to FIG. 2A, as well as FIG. 6A, the power to, and speed of, all of the conveyor platforms, i.e., main conveyor platform 12, slotted conveyor platform 20, transitional conveyor platform 32, and the bin-adjacent conveyor platform 34 may be powered by a motor 45, e.g., an electric motor, which may be controlled by a motor speed controller 35. A speed 136 of the conveyor system may be manually input via a user input device 144 on the user control panel 130, which may include keys, which may be touch screen keys, or a dial, which may be a touch screen dial, associated with the control module 100, and may be displayed on the display screen 128. The processor 102 then sends the speed 136 data, via output module 114, for example, to the motor speed controller 35 to drive the conveyor system.

The processor 102 also executes instructions, via output module 114, to the conveyors, to automatically stop and start, based on input signals from the sensors, as further described herein.

It should be recognized that while the control module 100 may, in embodiments, be packaged as a single unit together with the processor 102, memory 104, and communication interface 110, as shown, the term control module 100 should not be construed as requiring these components to be packaged together. In embodiments, one or more of the components may be operatively connected to the processor 102 and memory 104, but not co-located therewith. Likewise input modules 112 and output module 114 may be packaged separately from the processor 102, memory 104, and communication interface 110, or may also be part of a "packaged" unit, for example, a programming logic controller.

It should also be appreciated that the input module 112 and output module 114 of FIG. 6A may represent a plurality of input and output modules, respectively, each of which is configured for digital input and output, or analog input and output, respectively. For example, input modules will be configured based on the type of sensor, and on the control panel input. Likewise, some of the output modules 114 may be configured for digital output, for example, to on/off switches 68,69, and others may be configured for analog output, for example, to adjust the speed of the conveyors in response to analog user input via the user control panel 130.

Referring now to FIG. 6B, the user control panel 130 includes, in embodiments, the display screen 128, which may be a touch screen display. The user control panel 130 may also include a user-operable on switch 138, which may be, for example, a (start) push button 138, a user-operable off switch 140, which may be, for example, a (stop) push button 140, the (bin clear) momentary switch 142, and, in embodiments, an emergency stop switch 143 configured to turn off all power to the system 10. As described herein, the user control panel 130 may also be configured to accept user inputs via the display screen 128 for various parameters, which may be processed by the processor 102 and/or displayed on the display screen 128, including conveyor speed 136, log length 43, and a preselected number of logs 111.

The user control panel 130 is configured to send this user input to the control module 100, which handles inputs and outputs to the various actuators, solenoids, motors and sensors, as described herein, for example, via the input modules 112 and output modules 114. The control module 100 is programmed to monitor sensor data and user inputs to perform the automated decisions to complete the bagging process, in accordance with the methods of the present disclosure.

Additional data displayed on the user control panel 130 may include a bag counter 146 that provides a running count of the bags completed during a start cycle. The bag counter 146 is updated by one every time the lower hatch 52 opens and closes in response to activation of the user operable switch 160 before a cycle stops, e.g., via activation of the stop push button 140 on the user control panel 130.

The display screen 128 may also display the status of various operating parameters of the system 10, configured for easy monitoring by the user. For example, in embodiments, the display screen 128 may include a conveyor status indicator 148 of the conveyor system, including the bin-adjacent conveyor platform 34, to indicate that the conveyor system is on, in response to the user-operable on switch 138 being activated, and after verifying the system 10 is ready to operate without any errors, or off, in response to the user-operable off switch 140 being activated. The indicator 148 may be provided, in embodiments, as words, pictorial graphics, and/or colors, e.g., green for on, and red for off.

In additional embodiments, a graphical indicator 134, in embodiments, a data bar display, may also be displayed on the display screen 128, which is configured to graphically display, as a colored bar 135, the volume of logs 15 stacked in the upper bin 40. For example, the colored bar 135 may increase in height with every log 15 dropped into the bin, such that a distance 49' between the top of the colored bar and the top of the data bar display represents the distance 49 (see FIG. 3) between the second sensor 48 and the uppermost log 15' in the upper bin 40.

A lower bin status indicator 150 may also be provided on the display screen 128, to indicate whether the lower bin 50 is empty, or filled with the stack 17 of logs 15 dropped through the lower hatch 52, or still occupied with at least one log 15 after the lower hatch 52 is actuated, based on the signal from the third (proximity) sensor 58, indicating that the lower bin 50 is empty or occupied, after the lower hatch 52 has opened and closed, in accordance with the methods of the present disclosure. Any suitable type of indicator may be used alone, or in combination, such as text, color, bar display, or graphics.

Figure 7:
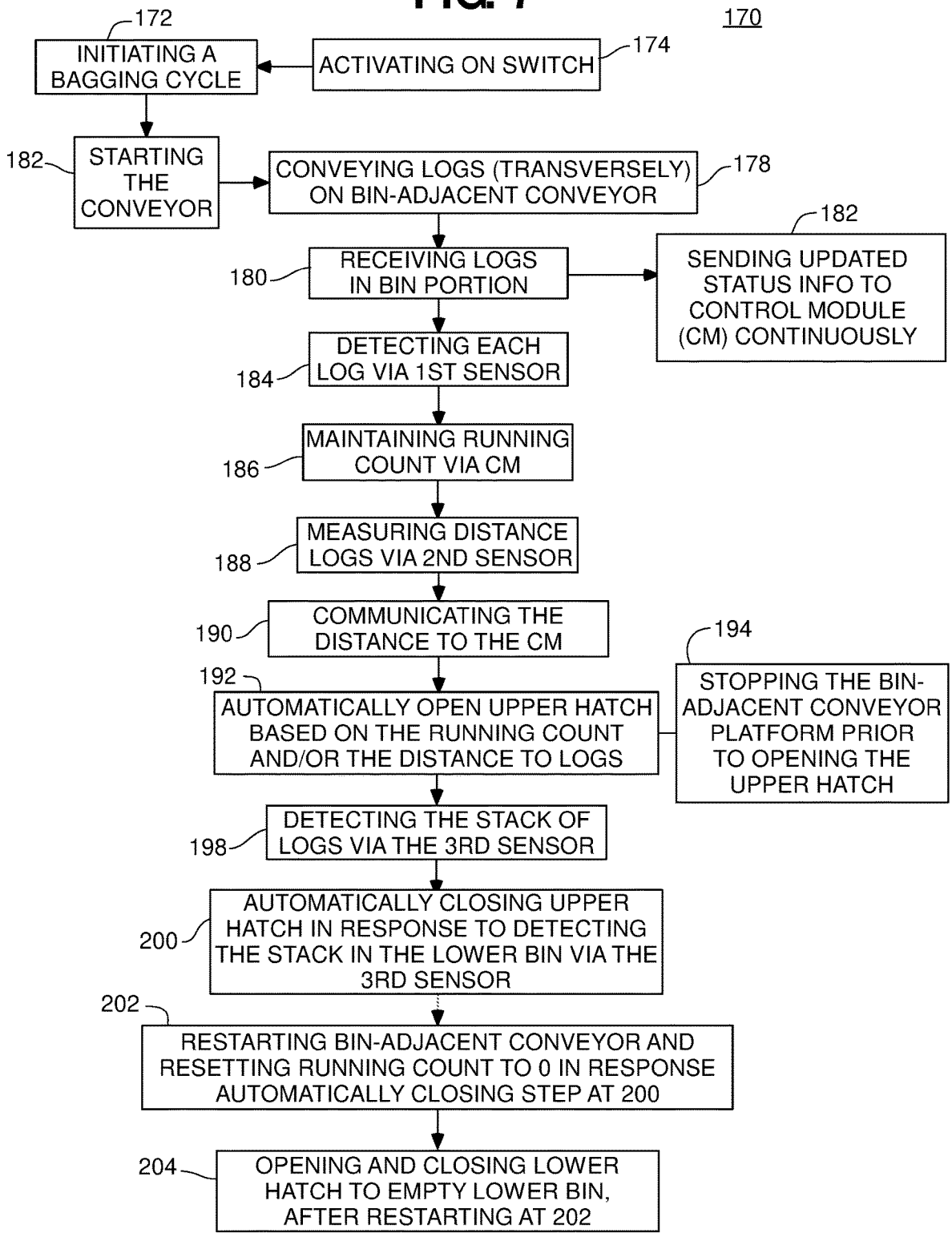
FIG. 7 is a flow chart representation of embodiments of a method of the present disclosure.

Referring to FIG. 7, an embodiment of a method 170 of the present disclosure may include initiating a bagging cycle, at 172, in response, for example, to activating, at 174, via a user-activated on switch 138, e.g., a start push button, on the user control panel 130.

Initiating the bagging cycle, at 172, may further include the control module 100, via the processor 102, checking input signals 115 from a plurality of sensors 80 (see FIG. 6A) associated with the bin portion 39 of the system to ensure that the bin portion 39, which may include upper bin 40 and lower bin 50, are empty and that the upper hatch 46 is closed and ready to receive logs 15. For example, in embodiments, the initiating step includes checking the second sensor 48, which is positioned above the upper bin and past the end of the bon-adjacent conveyor 34, to ensure that the upper bin 40 is empty, checking the third sensor 58 to ensure that the lower bin 50 is empty, and checking via the control module 100, the input signal 115 from the upper hatch sensor 61 to ensure the upper hatch 46 is closed.

In embodiments, the method includes starting the conveyor system, at 182, including the bin-adjacent conveyor platform 34, at the completion of the initiating cycle, at 172, via the processor 102 executing instructions to the motor controller 35. In embodiments, the conveyor system is started in response to a user activating the on switch 138, at 174. Logs 15 begin traveling on the conveyor system, eventually being conveyed, at 178, on the bin-adjacent conveyor platform 34 and toward the bin portion 39, with the logs 15 oriented transversely to the direction of travel 24 of the bin-adjacent conveyor platform 34, in embodiments, so that the logs dropped sequentially off the end of the bin-adjacent conveyor platform are received into the bin portion 39, at 180, in embodiments, into the upper bin 40, to form a stack.

Embodiments of the method 170 may further include the control module 100, via the processor 102, sending an updated status of the conveyor system, at 182, to the user control panel 130, which is displayed in the status indicator 148 portion of the display screen 128.

In embodiments, the method may further include detecting each log, at 184, via the first sensor 44, which is positioned before the end of the bin-adjacent conveyor platform 34, each log as it passes the first sensor and drops into the bin portion 39. In embodiments, the control module 100 continuously monitors the input signal 115 from the first (counting) sensor 44, the method further including maintaining, at 186, via the processor 102, a running count of the logs 15 that drop into the upper bin 40, based on the number of logs 15 that pass the first sensor 15. The method may further include, as part of the updating status steps, at 182, for example, updating the display counter 132 on the display screen 128, via the control module 100, each time a log 15 passes the first sensor 44, to maintain the running count of the logs 15. The method further includes continuing the maintaining the running count 186 and the conveying logs steps until the running count equals the preselected number 111 of logs.

In embodiments, the method may further include measuring a distance, at 188, via the second sensor 48, from the second sensor 48 to an uppermost log 15' of the stack of logs in the upper bin 40, or to the upper hatch 46 in an absence of logs in the upper bin 40.

For example, in embodiments, the control module 100 may continuously check the input signal 115 from the second sensor 48, which is configured to generate an output signal proportional to a distance 49 from the second sensor 48 to the uppermost log 15 of the stack 17 in the upper bin 40, or from the upper hatch 46 when the upper bin 40 is empty, the method further including, in embodiments, communicating the distance 49, at 190, via the second sensor 48, to the control module 100.

In further embodiments, at 182, for example, the control module 100 may also update the graphical indicator 135 on the display screen 128, wherein the graphical indicator is configured to graphically portray the distance 49 decreasing, i.e., the stack 17 rising in the upper bin 40.

In response to either the running count of logs 15 equaling the preselected number 111 of logs 15 or the distance from the second sensor 48 and the uppermost log 15' reaching a predetermined distance 126, the method further includes automatically opening the upper hatch 46, at 192, via the upper actuator 60 in communication with the control module 100. In embodiments, for example, once the running count of the logs 15 detected, at 184, equals the preselected number, the distance 49 is compared, via the processor 102, to the predetermined distance 126. If the distance 49 is less than the predetermined distance 126, the bin-adjacent conveyor platform 34 continues to drop logs 15 into the upper bin 40 until the distance 49 equals, or is less than the predetermined distance. The upper hatch 46 opens in response to the distance 49 equaling, or exceeding the predetermined distance.

In further embodiments, the method further includes stopping, at 194, the bin-adjacent conveyor 34, via the motor controller 35 in communication with the control module 100, prior to actuating the upper hatch 46 to open, at 192, in response in response to one of the running count of logs reaching a preselected number of logs, and the distance from the second sensor and the uppermost log reaching the predetermined distance 126, thereby dropping the logs 15 in one stack 17 into the lower bin 50.

Consequently, the third sensor 58, which is positioned and configured to detect a presence of logs 15 in the lower bin 50, for example, adjacent to the lower bin 50 just above the lower hatch 52, is now blocked. The method may further include detecting the stack of logs 15, at 198, in the lower bin 50, via the third sensor 58. In embodiments, the control module 100 updates, at 182, for example, the lower bin status indicator 150 to indicate it is full, and the graphical indicator 134 for the upper bin 40, to indicate it is empty.

In response to receiving the signal from the third sensor 58 indicating that the stack 17 is now received in the lower bin 40, the upper hatch 46 is actuated closed, via the first, upper, actuator 60, and the bin-adjacent conveyor 34 is restarted, at 202, in accordance with instructions received from the processor 102.

In embodiments, restarting the bin-adjacent conveyor 34, at 202, resets the running count based on the first signal from the first sensor 44, to zero. In embodiments, the method further includes resetting, via the control module 100, the display counter 132 to zero, based on the updated running count, and, in further embodiments, sending updated status data, at 182, for example, to the lower bin status indicator 150 on the display screen 128, indicating the lower bin 50 is full and ready for emptying, for example, into the open portion 56 below the lower bin 50 for bagging. In embodiments, the control module 100 also sends updated data, at 182, to the graphical indicator 134 on the display screen 128 to display the updated empty status of the upper bin 40.

In embodiments, a user seeing that the lower bin 50 is full may activate the manually operable switch 160 to open and close the lower the lower hatch 52, at 204, via the lower actuator 62, thereby emptying the lower bin 50, preferably while upper bin 40 is already refilling, and in embodiments, after restarting the bin-adjacent conveyor platform 34, at 202.

In embodiments, in response to the activation and deactivation of the manually operable switch 160, a number of bags displayed in the bag counter 146 portion on the display screen 128 is updated by one, via the control module, at 182, for example. The bag counter 146 continues to be updated with every opening of the lower hatch 52 until the run cycle is completed, e.g., until the off switch 69 is enabled, for example, via the stop push button or other user-activated off device 140 on the user control panel 130.

While particular embodiments of the present invention have been particularly shown and described with reference to specific embodiments, it should be apparent to those skilled in the art that the foregoing is illustrative only and not limiting, having been presented by way of example only. It is to be understood that the disclosed embodiments are merely examples, which may be embodied in various forms and detail without departing from the spirit and scope of the invention. Therefore, specific structural and functional details disclosed herein are not to be interpreted as limiting. Numerous other embodiments may fall within the scope of the accompanying claims and equivalents thereto.

What is claimed is:

1. A system for bundling wood, the system including comprising:

a bin-adjacent conveyor platform configured to transport logs in a transverse orientation relative to a direction of travel of the bin-adjacent conveyor platform, a longitudinal axis of each of the logs on the bin-adjacent conveyor platform being in a transverse orientation relative to the direction of travel; and a bin portion, wherein an end of the bin-adjacent conveyor platform is positioned above the bin portion, such that each log sequentially drops off the end of the bin-adjacent conveyor platform in the transverse orientation into the bin portion;

a first sensor positioned before the end of the bin-adjacent conveyor platform, the first sensor configured to detect each log as the log passes the first sensor in the transverse orientation and before the log sequentially drops off the end of the bin-adjacent conveyor platform;

a lower hatch formed in a bottom of the bin portion; and a control module, operatively connected to the first sensor, the control module including a processor, and configured to maintain a running count of logs detected by the first sensor;

wherein the lower hatch is configured to hingedly open and simultaneously drop a stack of logs therethrough based on the running count.

2. The system of claim 1, wherein the bin portion includes an upper bin including an upper hatch formed in a bottom of the upper bin and an upper actuator operatively connected to the control module and to the upper hatch, and a lower bin positioned below the upper bin, the lower bin including the lower hatch, wherein the upper bin is configured to receive each log detected by the first sensor and sequentially dropped off the end of the bin-adjacent conveyor platform to form the stack of logs, and wherein the control module is operatively connected to the upper actuator and is configured, via the upper actuator, to automatically open the upper hatch to drop the stack of logs into the lower bin based on the running count of logs.

3. The system of claim 2, wherein the control module is configured, via the upper actuator, to automatically open the upper hatch to drop the stack of logs into the lower bin in response to the running count of logs equaling a preselected number of logs.

4. The system of claim 2, further comprising a second sensor positioned above the bin portion and past the end of the bin-adjacent conveyor platform, wherein the second sensor is operatively connected to and in communication with the control module and is configured to measure a distance from the second sensor to an uppermost log of the stack of logs in the upper bin, or to the upper hatch in an absence of logs in the upper bin, and to communicate the distance to the control module, wherein the control module is configured, via the upper actuator, to automatically open the upper hatch to drop the stack of logs into the lower bin in response to one of the running count of logs reaching a preselected number of logs and the distance from the second sensor and the uppermost log reaching a predetermined distance.

5. The system of claim 4, further including a third sensor positioned and configured to detect a presence of logs on the lower hatch in the lower bin, the third sensor being operatively connected to and in communication with the control module, wherein the control module is configured, via the upper actuator, to automatically close the upper hatch in response to the third sensor detecting the logs in the lower bin corresponding to the stack of logs dropped into the lower bin from the upper bin.

6. The system of claim 5, wherein the control module is further configured to reset the running count to zero in response to the automatic closing of the upper hatch.

7. The system of claim 4, wherein the control module is further configured to stop the bin-adjacent conveyor platform and then automatically open the upper hatch to drop the stack of logs in response to one of the running count of logs reaching the preselected number of logs and the distance from the second sensor and the uppermost log reaching a predetermined distance.

8. The system of claim 7, wherein the control module is further configured to restart the bin-adjacent conveyor platform in response to the automatic closing of the upper hatch.

9. The system of claim 6, further including a user control panel operatively connected to the control module and a display screen operatively connected to and associated therewith, the display screen including at least one of a graphical indicator of a status of the upper bin and a display counter that continuously displays a number of logs in the upper bin based on the running count of logs, wherein the control module is configured to continuously update the at least one of the graphical indicator and the display counter to display the number of logs collected in the upper bin and to indicate, in response to the automatic closing of the upper hatch, an empty status of the upper bin.

10. The system of claim 5, further including a user control panel operatively connected to the control module and a display screen operatively connected to and associated therewith, the display screen including a lower bin status indicator configured to display a status of the lower bin as empty or full based on the third sensor, wherein the status switches to full in response to the third sensor detecting the logs in the lower bin corresponding to the stack of logs dropped into the lower bin from the upper bin.

11. The system of claim 1, further including a user control panel operatively connected to the control module, and a bagging portion adjacently below the lower bin, the user control panel including a user operable switch operatively connected to a lower actuator and configured to allow a user to open and close the lower hatch in use, via the user operable switch, to drop the stack of logs therethrough and into the bagging portion.

12. The system of claim 5, further including a lower actuator operatively connected to the control module and to the lower hatch, and a bagging portion positioned adjacently below the lower bin, and wherein the control module is configured to automatically open the lower hatch, via the lower actuator, and release the stack of logs into the bagging portion in response to the third sensor detecting the presence of logs in the lower bin corresponding to the stack of logs dropped from the upper bin.

13. The system of claim 1, further including:

a main conveyor device onto which the logs are fed in a random orientation from a log hopper;

a slotted conveyor platform positioned to transport the logs that exit from the main conveyor device, wherein the slotted conveyor platform includes a plurality of flat plates spaced apart on each of a plurality of rotatable axles, the plurality of rotatable axles being parallel to each other and spaced apart along the direction of travel of the slotted conveyor platform, wherein the plurality of rotatable axes and the plurality of flat plates are positioned and configured to urge each of the logs in a longitudinal orientation with the longitudinal axis aligned with the direction of travel of the slotted conveyor platform; and a transitional conveyor belt positioned to move and transfer the logs that exit the slotted conveyor platform to the bin-adjacent conveyor platform in the longitudinal orientation, wherein the bin-adjacent conveyor platform intersects the transitional conveyor belt perpendicular to the direction of travel of the transitional conveyor belt, such that the logs exiting the transitional conveyor belt are oriented in the transverse orientation relative to the direction of travel of the bin-adjacent conveyor platform.

14. The system of claim 13, wherein the slotted conveyor platform is positioned at a height above an input end of the transitional conveyor belt, the system further including a slide operatively connected between an exit end of the slotted conveyor platform and the input end of the transitional conveyor belt, wherein the slide is concave in cross-section transverse to the direction of travel, and wherein the direction of travel of the slide is curved and oriented to direct the logs in a downward and curved path and onto the input end of the transitional conveyor belt.

15. The system of claim 13, wherein the main conveyor device is positioned parallel to the transitional conveyor belt, with the direction of travel of the transitional conveyor belt being parallel to but opposite that of the main conveyor device.

16. The system of claim 14, further including a rotating arm connected to an outward extension of one axle of the plurality of rotatable axles proximate the slide and configured to operatively strike a portion of the slide as the rotating arm rotates with the one axle, the rotating arm configured to shake the slide to urge the logs downward along the slide and to agitate the logs to loosen debris therefrom, wherein the plurality of flat plates is also configured to agitate the logs urged along the direction of travel.

17. A method of bundling wood for bagging, the method comprising:

receiving into an upper bin, logs dropped sequentially off an end of a bin-adjacent conveyor platform to form a stack of logs in the upper bin, the upper bin including an upper hatch formed in a bottom floor of the upper bin;

providing a first sensor positioned before the end of the bin-adjacent conveyor platform, a second sensor positioned above the upper bin, an upper actuator configured to open and close the upper hatch, and a control module operatively connected to, and in communication with, the first sensor, the second sensor, the upper actuator, and the bin-adjacent conveyor platform;

detecting each log, via the first sensor, as the log passes the first sensor and before the log sequentially drops off the end of the bin-adjacent conveyor platform;

maintaining, via the control module, a running count of logs detected, via the first sensor, and dropped into the upper bin;

measuring a distance, via the second sensor, from the second sensor to an uppermost log of the stack of logs in the upper bin, or to the upper hatch in an absence of logs in the upper bin; communicating the distance, via the second sensor, to the control module; and automatically opening the upper hatch, via the upper actuator in communication with the control module, in response to one of the running count of logs reaching a preselected number of logs, and the distance from the second sensor and the uppermost log reaching a predetermined distance, thereby dropping the stack of logs into a lower bin.

18. The method of claim 17, further including stopping, via the control module, the bin-adjacent conveyor platform, in response to the one of the running count of logs reaching a preselected number of logs, and the distance from the second sensor and the uppermost log reaching a predetermined distance, and prior to the automatically opening the upper hatch.

19. The method of claim 18, further including:

providing a third sensor positioned and configured to detect a presence of logs in the lower bin;

detecting the stack of logs, via the third sensor, in the lower bin;

automatically closing, via the upper actuator, the upper hatch in response to the detecting the stack of logs; and restarting the bin-adjacent conveyor platform, via the control module, and resetting the running count to zero, via the control module, in response to the automatically closing the upper hatch.

20. The method of claim 19, further including:

providing a lower hatch formed in a bottom of the lower bin, and a lower actuator configured to open and close the lower hatch; and opening and closing the lower hatch, via the lower actuator, to empty the lower bin, after the restarting the bin-adjacent conveyor platform step.

21. The method of claim 17, wherein the receiving into the upper bin step includes receiving each log dropped sequentially off the end of the bin-adjacent conveyor platform in a transverse orientation, a longitudinal axis of each log being transverse to a direction of travel of the bin-adjacent conveyor platform.

22. A vertical unit for bundling a stack of wood received from a conveyor platform, the vertical unit comprising:

an upper bin positionable to receive logs dropped from a conveyor platform, the upper bin including an upper hatch formed in a bottom floor of the upper bin;

a lower bin positioned below the upper bin, the lower bin including a lower hatch formed in a bottom floor of the lower bin;

a first sensor positionable above an end of the conveyor platform, the first sensor configured to detect each log as the log passes the first sensor;

a control module operatively connected to the first sensor, the control module including a processor, and configured to maintain a running count of logs detected by the first sensor;

an upper actuator operatively connected to the control module and to the upper hatch;

a second sensor positioned above a bin portion, wherein the second sensor is operatively connected to and in communication with the control module and is configured to measure a distance from the second sensor to an uppermost log of the stack of logs in the upper bin, or to the upper hatch in an absence of logs in the upper bin, and to communicate the distance to the control module, wherein the control module is configured, via the control module, to automatically open the upper hatch, via the upper actuator, to drop the stack of logs into the lower bin in response to one of the running count of logs reaching a preselected number of logs and the distance from the second sensor and the uppermost log reaching a predetermined distance; and a third sensor positioned and configured to detect a presence of logs on the lower hatch in the lower bin, the third sensor being operatively connected to and in communication with the control module, wherein the control module is configured, via the upper actuator, to automatically close the upper hatch in response to the third sensor detecting the stack of logs dropped into the lower bin from the upper bin;

wherein the control module is further configured to reset the running count to zero and to restart the conveyor platform in response to the automatic closing of the upper hatch.

* * * * *